US006602046B2

(12) United States Patent
Kraus

(10) Patent No.: US 6,602,046 B2
(45) Date of Patent: Aug. 5, 2003

(54) DIFFUSOR WITHOUT ANY PULSATION OF THE SHOCK BOUNDARY LAYER, AND A METHOD FOR SUPPRESSING THE SHOCK BOUNDARY LAYER PULSATION IN DIFFUSORS

(75) Inventor: Peter Kraus, Krehfeld-Hüls (DE)

(73) Assignee: Universität Stuttgart, Stuttgart (DE)

( * ) Notice: Subject to any disclaimer, the term of this patent is extended or adjusted under 35 U.S.C. 154(b) by 0 days.

(21) Appl. No.: 09/930,404

(22) Filed: Aug. 15, 2001

(65) Prior Publication Data

US 2002/0018714 A1 Feb. 14, 2002

Related U.S. Application Data

(63) Continuation of application No. PCT/EP00/01300, filed on Feb. 15, 2000.

(30) Foreign Application Priority Data

Feb. 15, 1999 (DE) ..... 199 05 994

(51) Int. Cl.[7] ..... F01D 9/04

(52) U.S. Cl. ..... 415/1; 415/49; 415/211.2; 415/207; 415/914

(58) Field of Search ..... 415/1, 26, 47, 415/49, 211.2, 207, 914, 220, 221, 100, 103

(56) References Cited

U.S. PATENT DOCUMENTS

| | | | | |
|---|---|---|---|---|
| 3,149,470 A | * | 9/1964 | Herzog | 60/697 |
| 3,945,760 A | * | 3/1976 | Miller | 415/189 |
| 4,132,499 A | * | 1/1979 | Igra | 290/55 |
| 4,159,188 A | * | 6/1979 | Atencio | 290/53 |

* cited by examiner

*Primary Examiner*—Edward K. Look
*Assistant Examiner*—Kimya N McCoy
(74) *Attorney, Agent, or Firm*—Laurence A. Greenberg; Werner H. Stemer; Gregory L. Mayback

(57) ABSTRACT

A diffuser for slowing down a fluid and a method for operating a diffuser is described. A channel of the diffusor has an inlet with a smaller flow cross section than a flow cross section of an outlet and at least one opening for receiving an energizing fluid to be transported selectively into the channel. Pulsations of the impact interface are suppressed effectively at all of the operating points by injecting the energization fluid. Pressures of the fluid moving in the diffusor are measured, and amplitudes and frequencies of the measured pressures are evaluated. Energizing fluid is fed into the diffusor if the amplitudes within a predetermined frequency band exceed a threshold value. The utilization ratio of the inventive diffuser is considerably improved as a result of such a measure.

24 Claims, 8 Drawing Sheets

DIFFUSOR WITHOUT ANY PULSATION OF THE SHOCK BOUNDARY LAYER, AND A METHOD FOR SUPPRESSING THE SHOCK BOUNDARY LAYER PULSATION IN DIFFUSORS

CROSS-REFERENCE TO RELATED APPLICATION

This application is a continuation of copending International Application No. PCT/EP00/01300, filed Feb. 15, 2000, which designated the United States.

BACKGROUND OF THE INVENTION

Field of the Invention

The invention relates to a diffusor for decelerating a fluid, having at least one wall that forms a channel, having an inlet cross section and having an outlet cross section, with the flow cross section of the channel at the outlet cross section being larger than at the inlet cross section.

Such diffusors are found in a large number of conventional continuous flow machines. For example, the flow rate of the steam is reduced in a diffusor at the low-pressure end of a steam turbine, so that:

- the usable pressure or enthalpy drop across the turbine is increased;
- a proportion of the kinetic energy is converted to pressure energy;
- the flowing medium is decelerated; and
- the flow losses at the diffusor outlet toward the condenser groups are reduced.

The decreased supply of heat resulting from dissipation also reduces the cooling power required in the condenser that is positioned downstream in steam turbines.

Similarly, a draft tube is connected to Francis turbines through which a liquid flows to achieve the conversion from velocity energy to pressure energy mentioned above, and, thus, to increase the power of the turbine. In the case of gas turbines and other apparatuses through which flow passes at a high velocity, it is also desirable to recover at least a portion of the flow energy of the fluid by fitting a diffusor.

All types of diffusors have one fundamental problem in that separation effects can occur between flow and the wall of the diffusor due to the decelerated flow. These separation effects invariably reduce the free cross section of the diffusor and, hence, at least partially cancel out its effect.

Furthermore, the separation effects can result in what are referred to as shock boundary layer pulsations (hereinafter referred to as pulsations) in the fluid that can cause oscillation of the turbine blades, the casing of an upstream turbine, and the casing of the diffusor. These oscillations are highly undesirable because they represent an additional mechanical stress on the components affected by them, and can, thus, reduce the operational reliability and the life of these components to a major extent.

For such a reason, in the past, attempts have been made in widely differing ways to prevent the occurrence of shock boundary layer pulsations in diffusors, or to reduce their amplitude.

For example, attempts have been made to fit guide vanes in the channel of the diffusor to prevent detachment of the flow from the convex-curved wall of the diffusor. Such a configuration reduces the pulsation. However, the diffusor efficiency is reduced significantly throughout the entire operating period due to the permanently installed guide vanes.

Another approach to reducing pulsations is to increase the ratio of the outlet cross section to the inlet cross-section of the diffusor (pressure gradient variation). Even such a measure has not made it possible to entirely suppress shock boundary layer pulsations.

Furthermore, attempts have been made to use a kink in the wall of the diffusor to deliberately cause flow separation from the wall. The configuration allows the pulsations to be suppressed completely. However, the measure is associated with a considerable reduction in the diffusor efficiency.

SUMMARY OF THE INVENTION

It is accordingly an object of the invention to provide a diffusor without any pulsation of the shock boundary layer, and a method for suppressing the shock boundary layer pulsation in diffusers that overcomes the hereinaforementioned disadvantages of the heretofore-known devices and methods of this general type and that provides a diffusor and a turbine having relatively good efficiency throughout the entire operating envelope and throughout the entire operating life, and during whose operation no shock boundary layer pulsations occur. Furthermore, the invention provides a method for effectively suppressing pulsations in a diffusor.

With the foregoing and other objects in view, there is provided, in accordance with the invention, a diffusor for decelerating a moving fluid including at least one wall forming a channel for receiving a moving fluid, the at least one wall having an inlet, an outlet, and at least one opening for receiving an energizing fluid to be transported selectively into the channel, the inlet having a relatively smaller inlet flow cross section and the outlet having a relatively larger outlet flow cross section.

Passing the energizing fluid into the channel results in the deliberate supply of energy to the fluid whenever pulsations occur to suppress the pulsation and prevent damage to the turbine blades of an upstream turbine or of the diffusor.

In accordance with another feature of the invention, the inlet opening or openings are circular in shape or in the form of an elongated or elliptical hole. Thus, the openings are easy to produce and have only a small notch effect.

In accordance with a further feature of the invention, the inlet opening or openings are disposed in at least one or more regions of the wall, in particular, in those regions in which pulsation of the shock boundary layer between the fluid and the wall occurs so that the extent to which the wall of the diffusor is weakened by the inlet openings remains low. Furthermore, passing of the energizing fluid into the region or regions of the wall in which pulsation of the shock boundary layer occurs deliberately influences or suppresses the pulsation.

In accordance with an added feature of the invention, the channel has an annular cross section so that diffusers having an inner shell and a convex-curved outer shell can also be operated reliably and with high efficiency at all operating points.

In accordance with an additional feature of the invention, the fluid arrives in the diffusor in an axial direction and/or has a swirl in the inlet cross-section and/or the fluid emerges from the diffusor in the radial direction. Thus, a diffusor according to the invention can easily be installed between a steam turbine and a condenser with widely differing inlet and outlet flow conditions.

In accordance with yet another feature of the invention, to simplify production and to improve the flow conditions, the diffusor and/or the wall of the diffusor are rotationally symmetrical.

In accordance with yet a further feature of the invention, there is provided at least one pressure sensor on the diffusor. The pressure sensor measures the pressure of the fluid in a non-stationary manner so that continuous monitoring for the occurrence of pulsations during operation is feasible.

In accordance with yet an added feature of the invention, the pressure sensor measures pressures of the moving fluid at various locations in the channel.

In accordance with yet an additional feature of the invention, there is provided a controller. The controller determines amplitudes and frequencies of the pressures measured by the pressure sensor, controls movement of the energizing fluid into the diffusor, and initiates the movement of the energizing fluid into the diffusor when the amplitudes within a predetermined frequency band exceed a threshold value. The configuration ensures, on one hand, that energizing fluid is passed into the diffusor whenever pulsations occur and, on the other hand, that the movement of the energizing fluid is prevented when no pulsations are measured. The configuration has no adverse effect whatsoever on the efficiency of the diffusor according to the invention at those operating times at which no pulsations occur, and the diffusor efficiency is reduced to only a very minor extent just during the comparatively short operating periods in which a pulsation occurs. The efficiency of the diffusor according to the invention is, therefore, just as good, in all operating situations, as the efficiency of a diffusor according to the prior art when no pulsations are occurring in such a diffusor. Comparatively, however, the efficiency of a diffusor according to the invention when no pulsations occur is considerably better than the efficiency of a diffusor according to the prior art in similar conditions. The operational reliability of a turbine equipped with a diffusor according to the invention is considerably better than that in the prior art.

In accordance with again another feature of the invention, the energizing fluid has the same consistency, or a similar consistency, or a different consistency, to that of the fluid. Thus, an energizing fluid is available, cost-effectively and without any additional hardware, for example, by tapping off part of the steam flow in the medium-pressure or low-pressure part of the upstream steam turbine, whose parameters (pressure, temperature, mass flow) can be set precisely to the operational purpose. For example, steam from a tapping line from a steam turbine can be used as energizing fluid.

In accordance with again a further feature of the invention, the energizing fluid is compressed air so that the pulsations can be suppressed without any changes to the turbine or to any other apparatus upstream of the diffusor according to the invention.

With the objects of the invention in view, there is also provided a turbine including a rotor, a casing for receiving a flow of fluid to drive the rotor, the rotor being disposed in the casing and being driven by the fluid, and a diffusor for decelerating the fluid. The diffusor is disposed in the casing downstream of the rotor in a flow direction of the fluid and has at least one wall forming a channel for receiving the fluid. The at least one wall has an inlet, an outlet, and at least one opening for receiving an energizing fluid to be transported selectively into the channel. The inlet has a relatively smaller inlet flow cross section and the outlet has a relatively larger outlet flow cross section. Thus, all of the advantages mentioned above related to the diffusor according to the invention are also present in a turbine according to the invention.

In accordance with again added features of the invention, the turbine is a steam turbine, a low-pressure steam turbine, a gas turbine, a water turbine, or a Francis turbine so that pulsation in the diffusor of the steam or gas turbine or in the draft tube of the Francis turbine is suppressed regardless of the various fluids with which the turbines are operated.

With the objects of the invention in view, there is also provided a method for preventing shock boundary layer pulsations in the diffusor, in which:

the pressure of the fluid in the diffusor is measured in a non-stationary manner;

the amplitudes and frequencies of the measured pressures are evaluated; and energizing fluid is passed into the diffusor if the amplitudes within a predetermined frequency band exceed a threshold value.

With the objects of the invention in view, there is also provided a method for preventing shock boundary layer pulsations in a diffusor including the steps of measuring pressures of a moving fluid at various locations in a diffusor, evaluating amplitudes and frequencies of the measured pressures, and feeding energizing fluid into the diffusor if the amplitudes within a predetermined frequency band exceed a threshold value.

The methods according to the invention makes it possible, whenever an operating point is approached at which pulsations occur, for these pulsations to be measured, identified, and suppressed by passing energizing fluid into the diffusor. Thus, inter alia, even existing diffusers in which pulsations occur can be monitored, and the pulsations can be suppressed by passing energizing fluid into the diffusor. Accordingly, all relatively old power stations can be retrofitted with the method according to the invention to allow a diffusor optimized according to the present-day prior art to be installed in all power stations without any risk of the stations being subjected to oscillations. Relatively modern power station complexes, including those presently being constructed, can, of course, also be retrofitted with the method according to the invention.

Other features that are considered as characteristic for the invention are set forth in the appended claims.

Although the invention is illustrated and described herein as embodied in a diffusor without any pulsation of the shock boundary layer, and a method for suppressing the shock boundary layer pulsation in diffusers, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
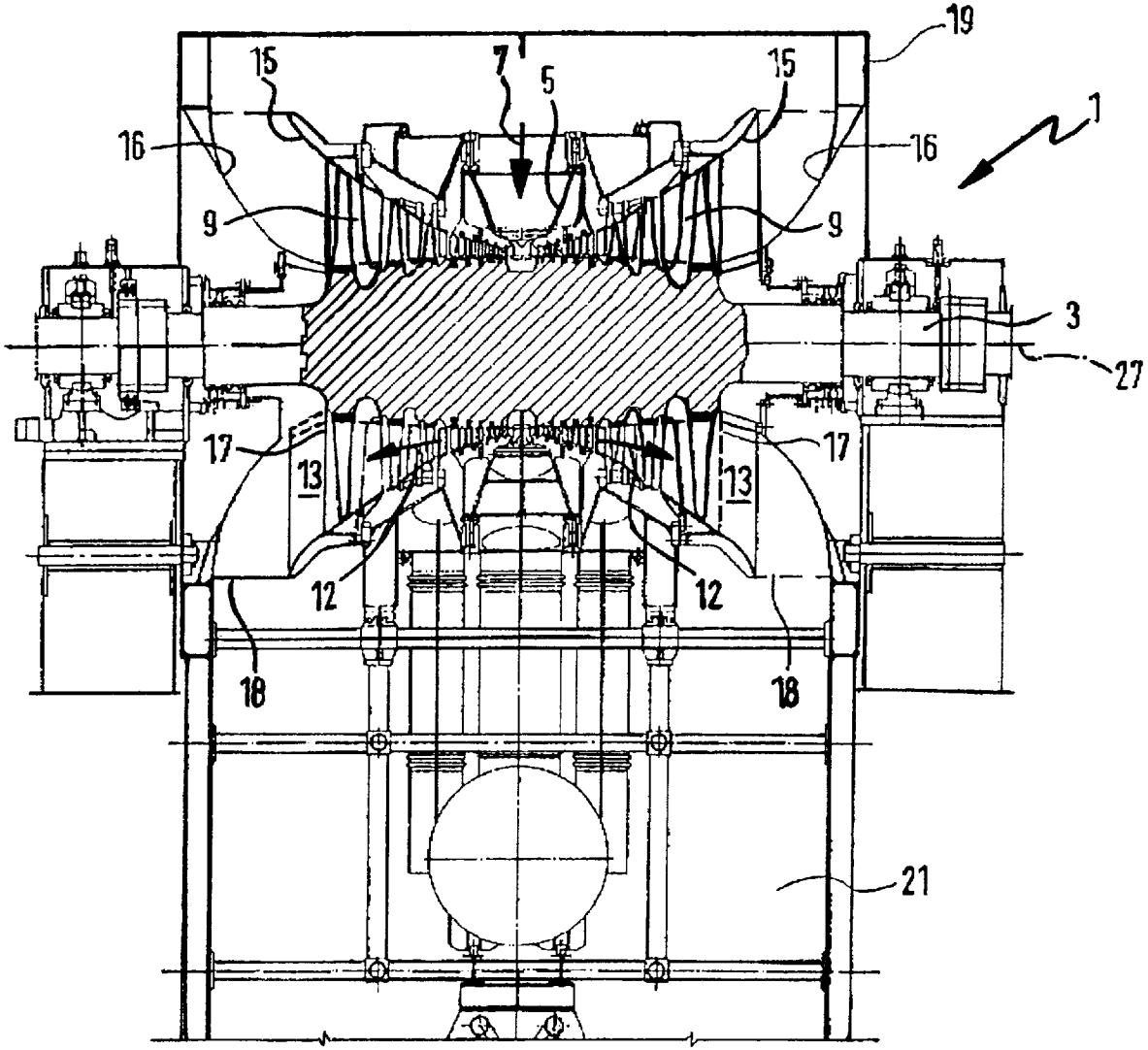
FIG. 1 is a longitudinal cross-section view through a low-pressure steam turbine according to the invention.

In all the figures of the drawing, sub-features and integral parts that correspond to one another bear the same reference symbol in each case.

Referring now to the figures of the drawings in detail and first, particularly to FIG. 1 thereof, there is shown a longitudinal section of a low-pressure (LP) steam turbine 1 having a horizontally running shaft 3. The steam, which is indicated by an arrow 7 and is referred to as a fluid in the following text, is passed into the LP steam turbine through an inlet flow line 5. The turbine contains a guide apparatus 9 that passes the fluid to a rotor 11. See FIG. 2. Once the fluid has passed along the arrows 12 through a number of rows of guide vanes 9 and has flowed through the rotor 11, which has a number of rows of rotor blades, and in the process has emitted work to the shaft 3, it reaches diffusors 13. The diffusors 13 each have a convex-curved outer shell 15 and a concave-curved inner shell 16. The fluid enters the diffusor 13 through a diffusor inlet 17, and emerges from it through a diffusor outlet 18. The diffusors 18 are followed by an exhaust steam casing 19 and a condenser 21, which is only indicated diagrammatically.

Figure 2:
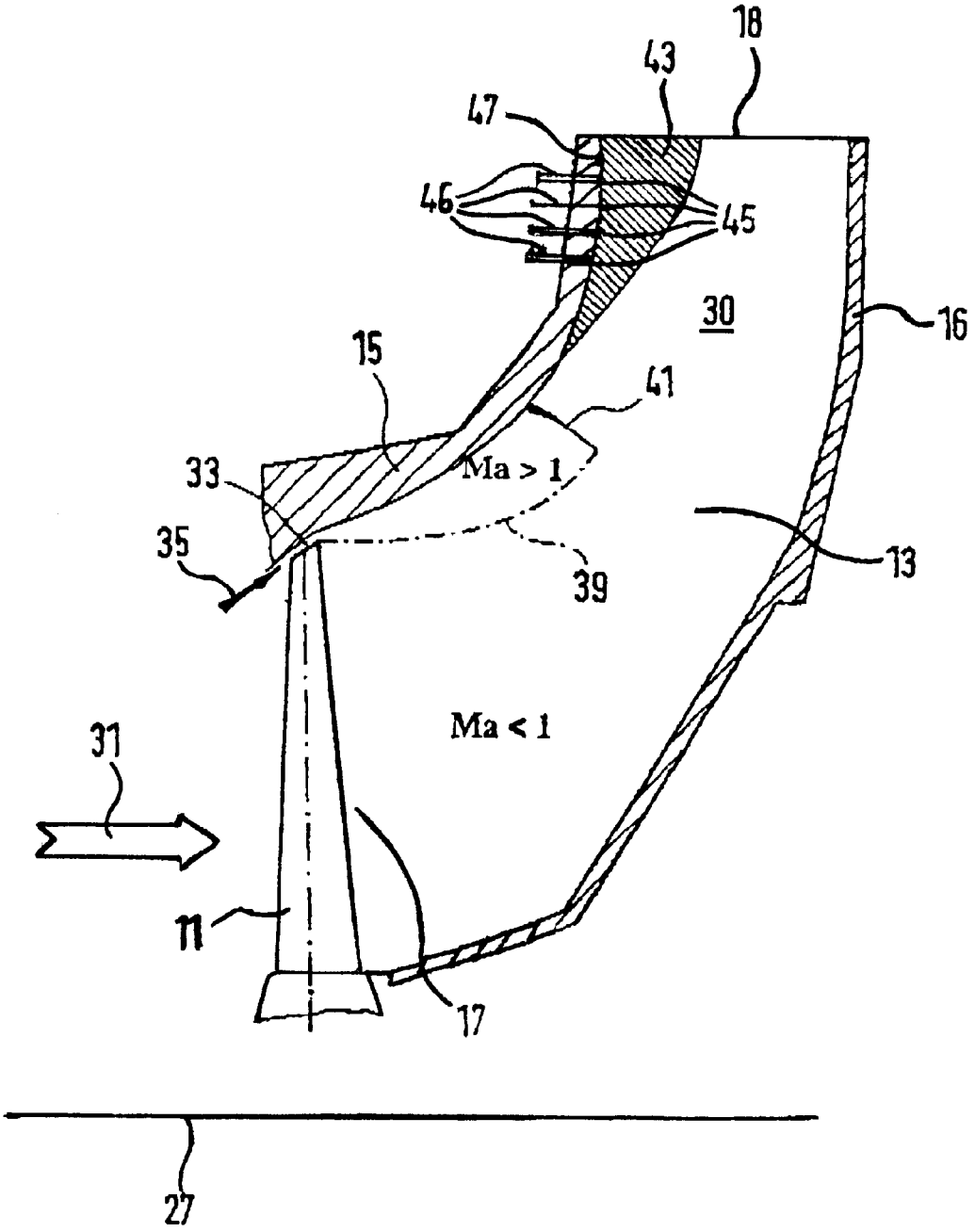
FIG. 2 is a fragmentary, partial, cross-sectional view through a rotor of a steam turbine and a diffusor connected to the steam turbine according to FIG. 1.

FIG. 2 illustrates a partial section of a rotor 11 with a diffusor 13. The rotor 11, of which only one rotor blade is illustrated, rotates about the longitudinal axis 27 when flow is directed at the rotor 11. The outer shell 15 and the inner shell 16 form a channel 30 through which the fluid flows.

The main mass flow 31 of the fluid passes through the rotor 11 into the diffusor 13. A tapped-off mass flow 35 passes into the diffusor through the gap 33 between the rotor 11 and the outer shell 15 of the diffusor 13. The flow velocity in the gap 33 is higher than that of the main mass flow 31 because the rotor 11 does not decelerate the tapped-off mass flow 35. Following the final row of rotor blades on the shaft 3, the tapped-off mass flow 35 is additionally accelerated in a comparable manner to that of a Laval nozzle as well.

The outlet flow of the fluid from the turbine, which is indicated by the rotor 11, into the diffusor 13 is influenced to a major extent by the interaction between the main mass flow 31 and the tapped-off mass flow 35. The energizing effect that the tapped-off mass flow 35 exerts on the flow boundary layer on the outer shell of the diffusor is particularly important for the axiradial deflection of the fluid in the diffusor 13. The energizing of the boundary layer by the tapped-off mass flow 35 may be regarded as the reason for the shift of the separation region on the outer shell 15 in the direction of the diffusor outlet 18 and the reduction, induced in such a way, in the blocking effect that occurs due to boundary layer separation. The blocking effect is at its greatest at the diffusor outlet 18.

FIG. 2 is a schematic two-dimensional illustration of the flow states that occur in the axiradial deflection in the profile of the diffusor 13. In the operating state illustrated in FIG. 2, the tapped-off mass flow 35 passes at supersonic speed (Ma>1) into the diffusor 13, while the main mass flow 31 passes into the diffusor 13 at subsonic speed (Ma<1). The boundary between these two areas is indicated by a speed-of-sound line 39. The location of the compression shock is represented by line 41. Furthermore, a separation region 43 is shown on the outer shell 15, within which the fluid flow is detached from the outer shell 15.

The gap energization has a disadvantageous effect on flow through the diffusor in relatively high load states because it causes shock boundary layer pulsation, also referred to as diffusor humming, on the wall contour for certain relationships between the static pressures in the diffusor inlet and outlet. The pulsation can successively have a disadvantageous influence over a large area of diffusor flow and causes undesirable blade oscillations in the rotor 11. The flow phenomenon of shock boundary layer pulsation is a major research subject in many aerodynamic areas due to its damaging effect on the adjacent flow fields because the flow states are dependent on the frequency and the amplitude of the pulsation.

The extent of the efficiency losses caused by pulsation, and the damaging effect of pulsation on the rotor blades in the low-pressure steam turbine 1 and in the diffusor 13 can be suppressed, according to the invention, by one or more openings 45 in the diffusor 13. An energizing fluid, which is not illustrated in FIG. 2, can be passed through the openings 45 into the diffusor through supply lines 46. Suitable choice of the location, the shape and the opening cross section of the openings 45, and of the pressure that is used to pass the energizing fluid into the diffusor 13, has made it possible to completely suppress any pulsations that occur with the diffusers and operating states investigated so far. The pulsations can be detected with a pressure sensor 47 that measures in a non-stationary manner.

Due to the complex three-dimensional flow conditions in a diffusor, it is not possible to provide a general specification for the location or locations at which openings 45 should be incorporated. However, it has been found to be promising to introduce one or more openings 45 in the separation region or regions 43. The hydraulic diameter of the openings 45 and the pressure at which the energizing fluid is passed into the diffusor 13 must be determined and set on an individual basis. Furthermore, the direction and the speed with which the energizing fluid is supplied can result in an additional increase in efficiency.

Figure 3:
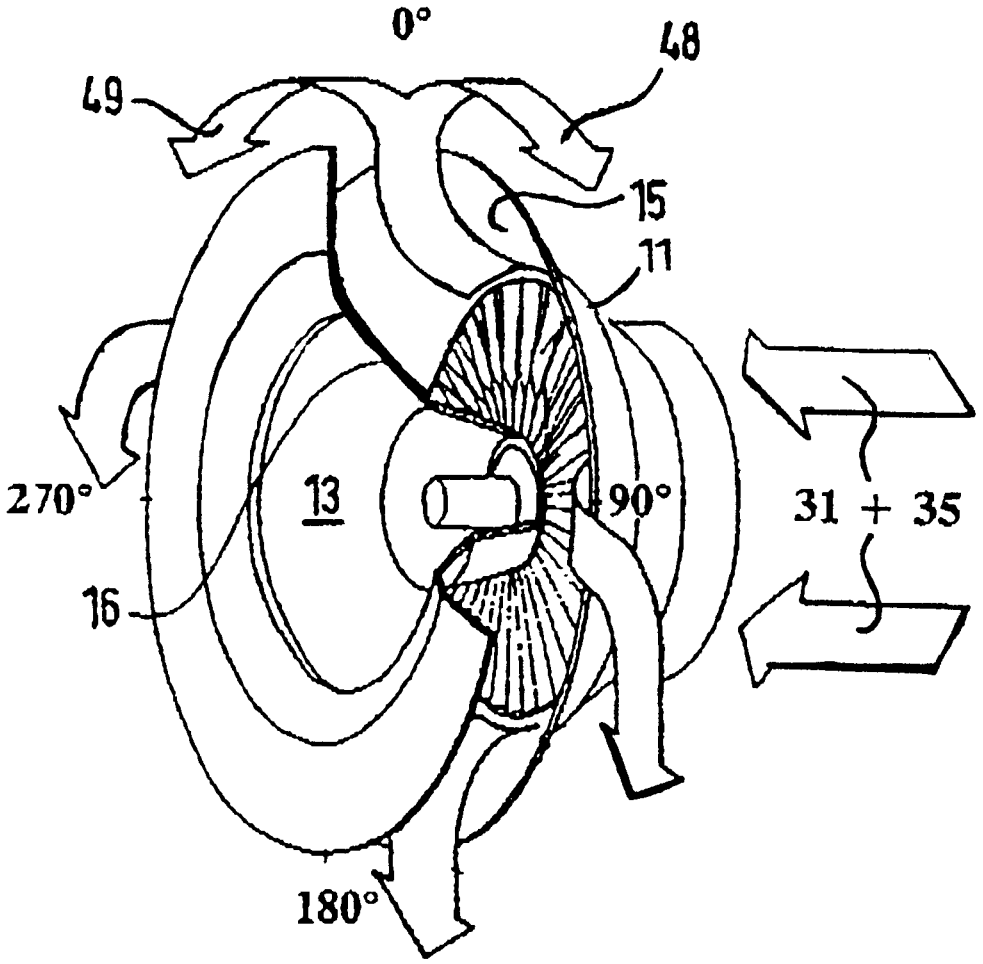
FIG. 3 is a partly broken away, perspective view of a rotor of a steam turbine and of a diffusor according to the invention.

FIG. 3 is a perspective illustration, in the form of a partial section, of how the total mass flow 31+35 is split after passing through a turbine and a diffusor 13. If the configuration is imagined as being installed in the exhaust-steam casing 19 illustrated in FIG. 1, it is clear that the total mass flow, as shown in FIG. 3, flows away downward after emerging from the diffusor. The portion of the total mass flow that emerges from the diffusor 13 at the top at the relative angle 0° is split into right-hand and left-hand parts 48, 49. The total mass flows that emerge at the relative angles of 90° and 270° at the sides shown in FIG. 3 are deflected downward. Different outlet flow conditions over the circumference of the diffusor outlet translates into pulsations that occur not being the same over the circumference of the diffusor outlet.

Figure 4:
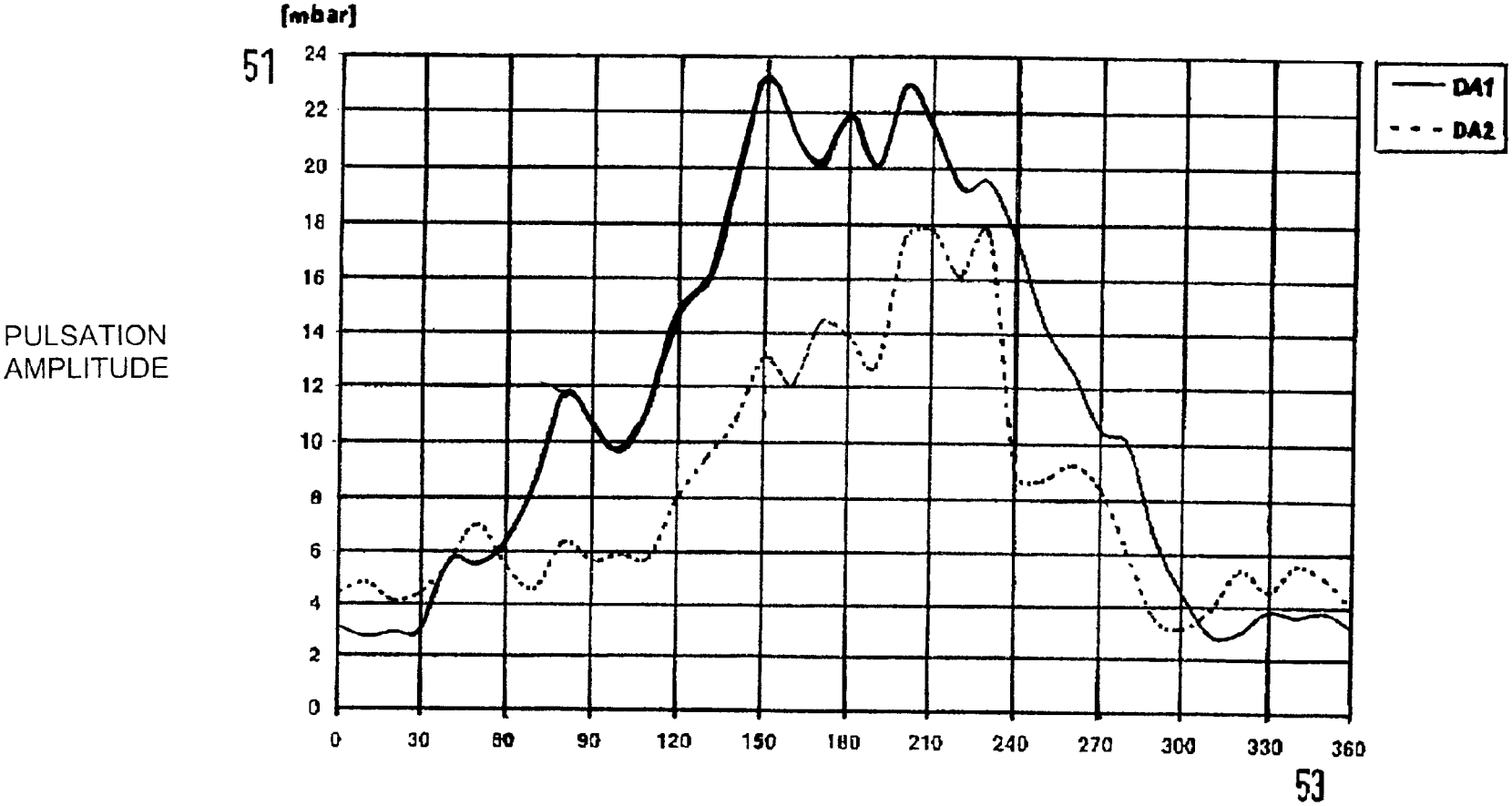
FIG. 4 is a graph illustrating the amplitude of a pulsation in a turbine plotted over the circumference of the diffusor outlet.

FIG. 4 is a graph of the magnitude of the pulsation amplitudes 51 plotted over the circumference 53. The subdivision in the form of degrees corresponds to the subdivision in the form of degrees illustrated in FIG. 3. FIG. 4 illustrates the results for amplitudes that were measured for a constant flow state with pressure sensors DA1 and DA2 measuring in a non-stationary manner. The different curved profile recorded by DA1 and DA2 is due to the fact that the measurements were taken at different positions. It can be seen from FIG. 4 that the pulsation amplitudes in the area between 150° and 210° measured by a first pressure sensor DA1 are the largest. The measured values recorded by a second pressure sensor DA2, which are represented by the dashed line, are somewhat lower overall, but also have a pronounced maximum in the area between 190° and 215°.

It can be seen from FIG. 4 that the pulsations in the outlet flow of the total mass flow shown in FIG. 3 differ over the circumference. Accordingly, it is recommended that inlet openings 45 and/or pressure sensors be located in the area of the high amplitudes so that, first, the pulsations can be seen easily and clearly and, second, the pulsations are suppressed as effectively as possible by passing energizing fluid into the diffusor.

These processes can be completely automated so that the procedure from recognition of the occurrence of pulsation to the passing of energizing fluid into the diffusor can be carried out automatically in the diffusor according to the invention. The method of operation has a further advantage that energizing fluid is passed into the diffusor only when pulsations occur.

The effectiveness of the method according to the invention and the advantage of a diffusor according to the invention over a diffusor according to the prior art are shown in FIGS. 5 to 8, which each show the pulsation amplitude 51, measured by a pressure sensor 47 in the diffusor 13, plotted against frequency 55.

Figure 5:
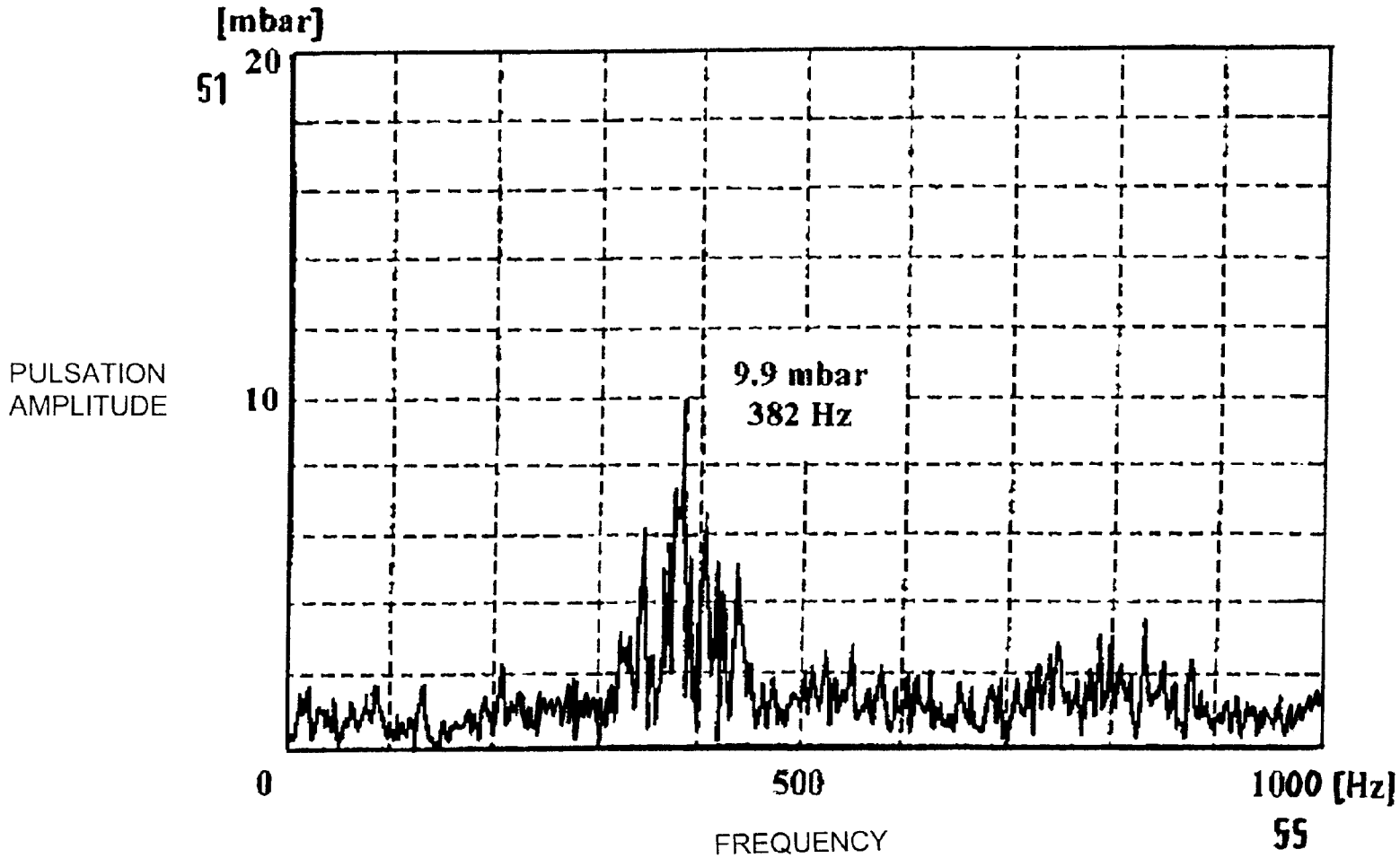
FIG. 5 is a graph illustrating measured pulsation amplitudes at an operating point in a diffusor according to the prior art, plotted against frequency.
Figure 6:
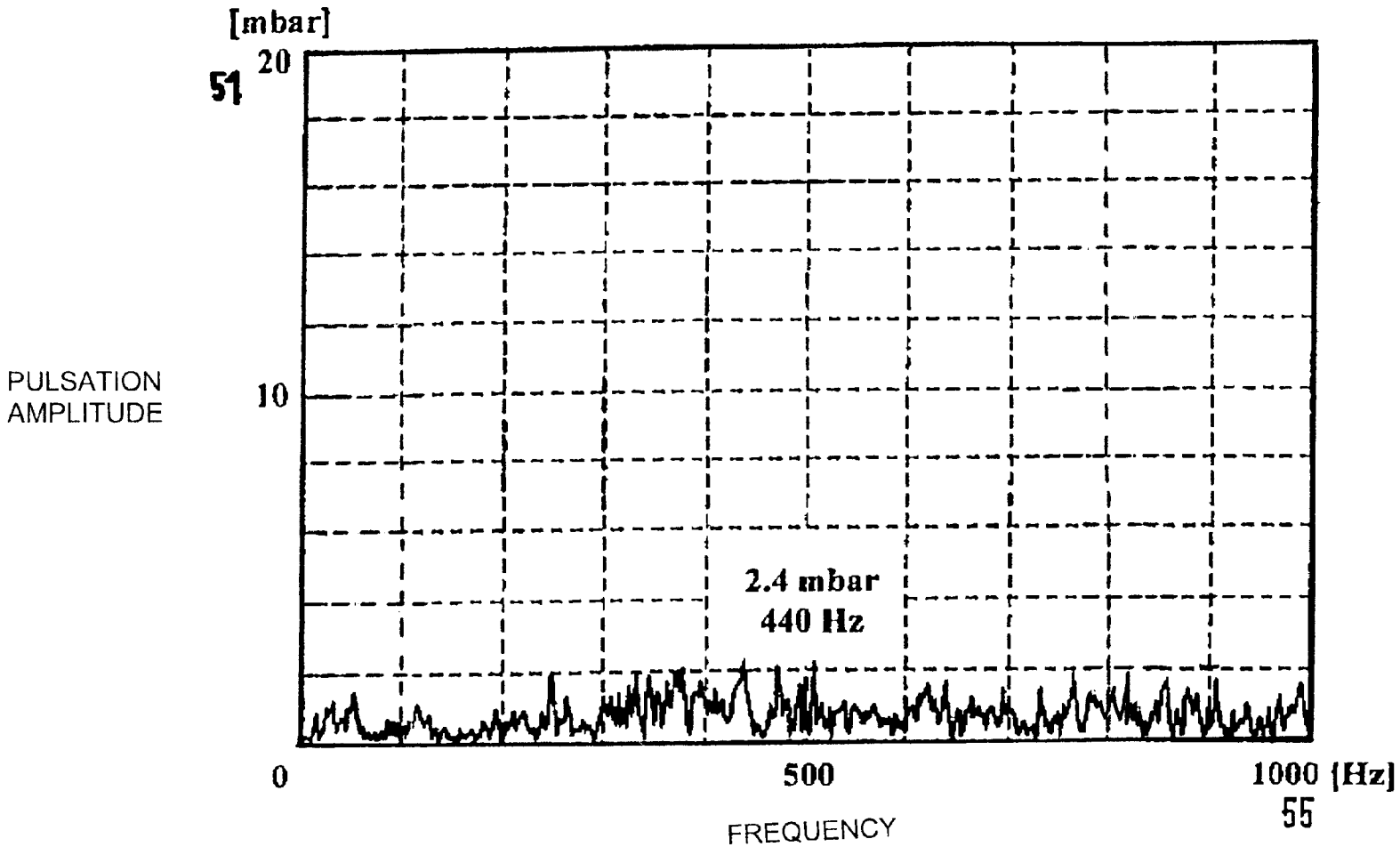
FIG. 6 is a graph illustrating measured pulsation amplitudes at the FIG. 5 operating point of the diffusor according to the invention, plotted against frequency.

FIG. 5 illustrates an operating state of a diffusor according to the prior art, in which a pulsation is occurring at an amplitude of 9.9 mbar at 382 Hz. Passing energizing fluid into the diffusor according to the invention reduces the amplitude to 2.4 mbar at 440 Hz with the operating conditions otherwise being the same, as illustrated in FIG. 6. In other words, completely suppressing such a pulsation. The diffusor efficiency has been reduced only to a very minor extent compared to its efficiency at the nominal point.

Figure 7:
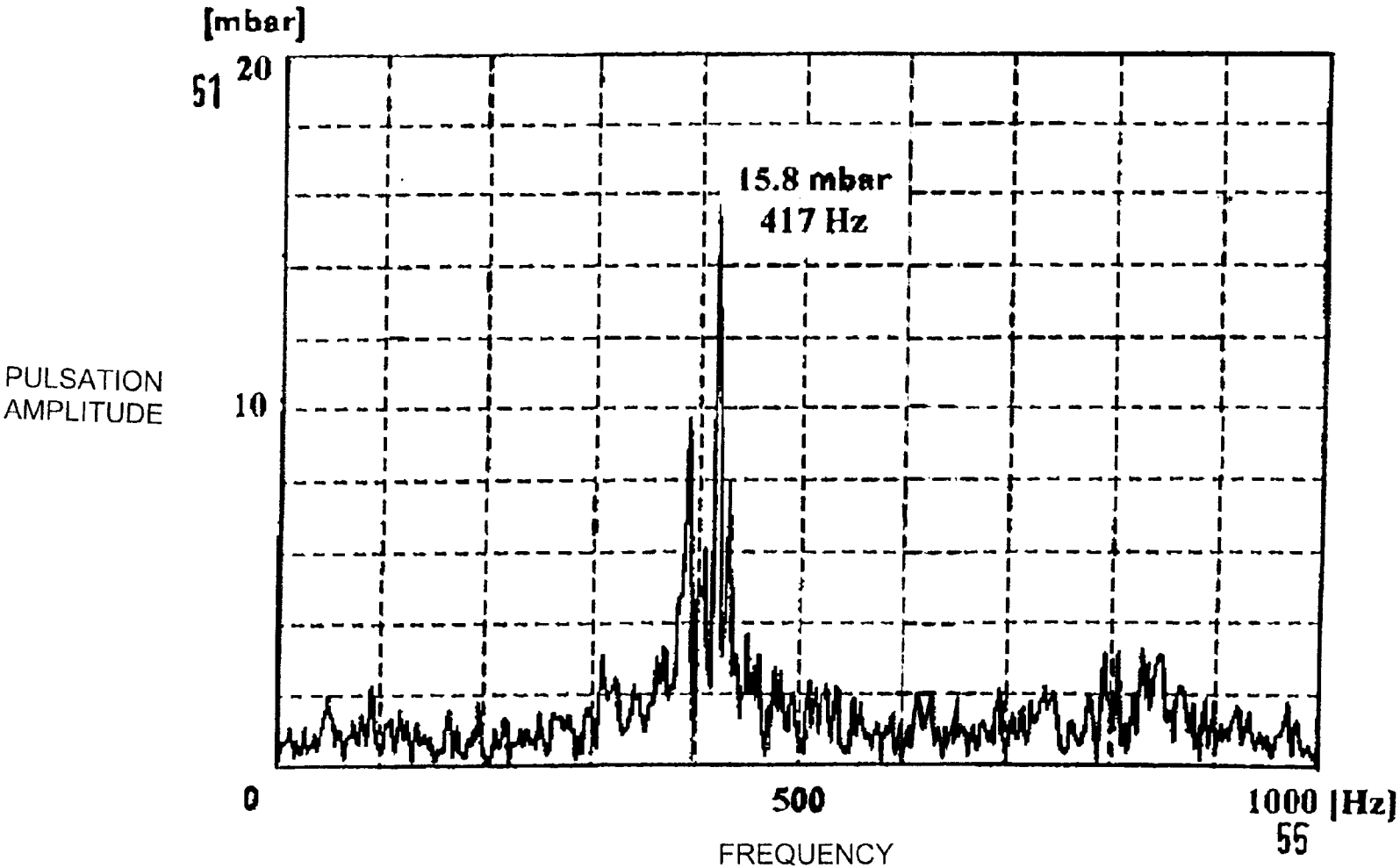
FIG. 7 is a graph illustrating measured pulsation amplitudes plotted against frequency at a second operating point of a diffusor according to the prior art.

FIG. 7 illustrates a second operating state of the turbine or of the diffusor, in which an amplitude of 15.8 mbar was measured at 417 Hz without any energizing fluid being passed into the diffusor.

Figure 8:
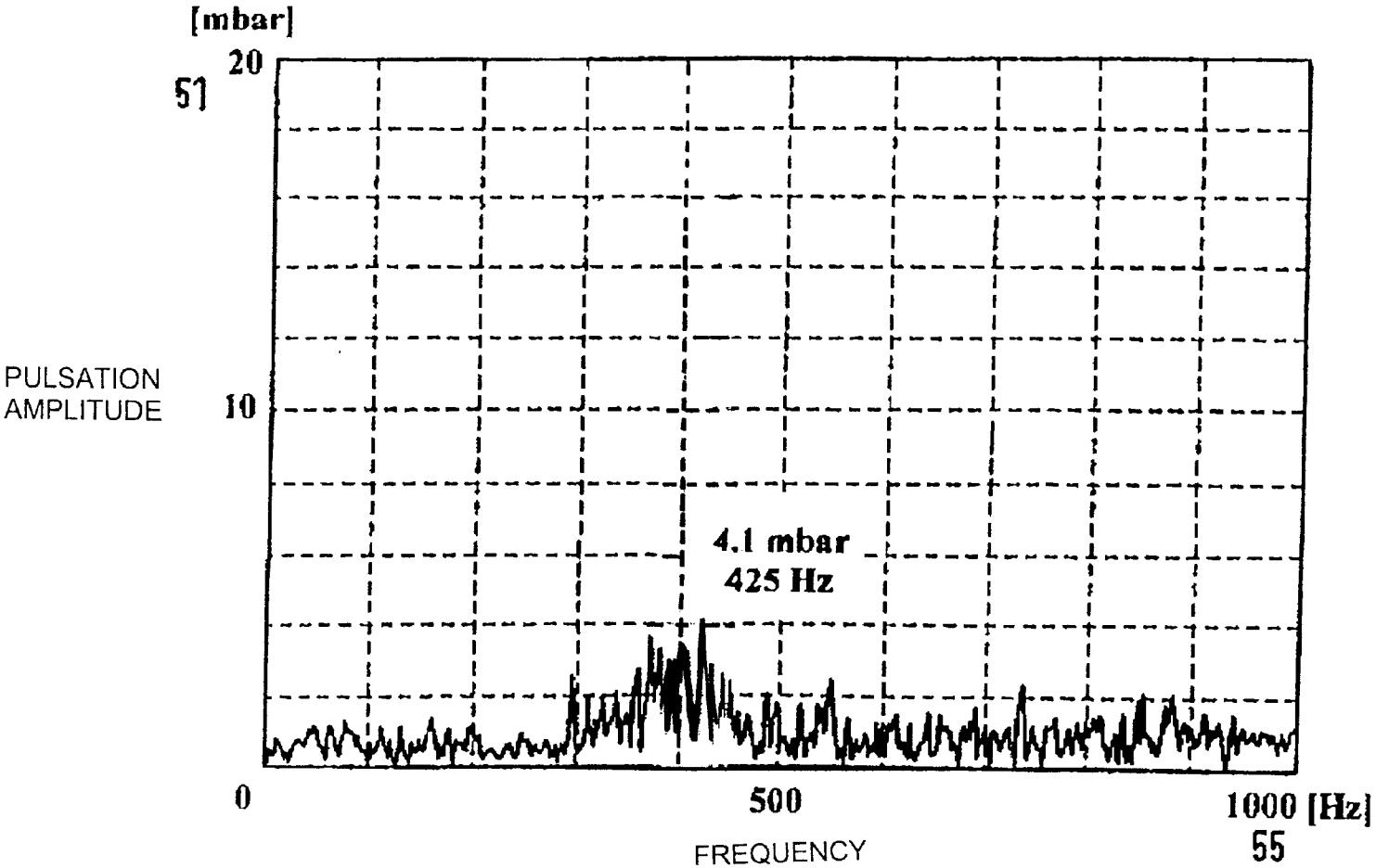
FIG. 8 is a graph illustrating measured pulsation amplitudes plotted against frequency for a diffusor according to the invention at the second operating point.

FIG. 8 illustrates the measured pressure profile for the same turbine and diffusor operating conditions, but with energizing fluid being passed into the diffusor. In the FIG. 8 configuration, the amplitude has been reduced to 4.1 mbar at 425 Hz. Such a result can also be regarded as complete suppression of the pulsation.

The use of a diffusor according to the invention and the use of the method according to the invention, therefore, allows the pulsation to be completely suppressed. Whether the fluid is steam, flue gas, air, or, for example, water is irrelevant.

Similar effects can also occur in the draft tubes of water turbines, in particular, of Francis turbines, and can be overcome by the device and method features described above. The method according to the invention can be used for compressible and incompressible fluids of all types.

All the features explained in the description, presented herein and illustrated in the drawings may be significant to the invention both individually and in any combination with one another.

I claim:

1. A diffusor for decelerating a moving fluid, comprising:

at least one wall forming a channel for receiving the moving fluid, said at least one wall having an inlet, an outlet, and at least one opening for receiving an energizing fluid to be transported selectively into said channel, said inlet having a relatively smaller inlet flow cross section and said outlet having a relatively larger outlet flow cross section;

said channel defining an axial direction, the fluid entering the diffusor in said axial direction; and said channel defining a radial direction, the fluid discharging from the diffusor in said radial direction.

2. The diffusor according to claim 1, wherein said at least one opening has one of a circular shape and an elliptical shape.

3. The diffusor according to claim 1, wherein:

said at least one opening is a plurality of openings;

said at least one wall has at least one region; and said openings are disposed in said at least one region.

4. The diffusor according to claim 3, wherein said at least one region is disposed at a location where pulsation of a shock boundary layer between the moving fluid and said at least one wall occurs.

5. The diffusor according to claim 1, wherein:

said at least one opening is a plurality of openings;

said at least one wall has at least two regions; and said openings are disposed in each of said at least two regions.

6. The diffusor according to claim 5, wherein at least one of said at least two regions is disposed at a location where pulsation of a shock boundary layer between the fluid and said at least one wall occurs.

7. The diffusor according to claim 1, wherein said channel has an annular cross section.

8. The diffusor according to claim 1, wherein the energizing fluid enters the diffusor through said at least one opening in said axial direction.

9. The diffusor according to claim 1, wherein:

said channel has a longitudinal axis;

said at least one wall is disposed downstream of a rotor in a flow direction of the fluid; and the fluid enters the diffusor through the rotor substantially along said longitudinal axis.

10. The diffusor according to claim 1, wherein the fluid has a swirl at said inlet flow cross section.

11. The diffusor according to claim 1, wherein said at least one wall is rotationally symmetrical.

12. The diffusor according to claim 1, including at least one pressure sensor for measuring pressures of the moving fluid at various locations in said channel.

13. The diffusor according to claim 1, including at least one pressure sensor for non-stationarily measuring pressures of the moving fluid in said channel.

14. The diffusor according to claim 13, including a controller programmed to determine amplitudes and frequencies of pressures measured by said at least one pressure sensor and to control movement of the energizing fluid into said at least one opening.

15. The diffusor according to claim 14, wherein said controller is programmed to initiate movement of the energizing fluid into said at least one opening when said amplitudes within a predetermined frequency band exceed a threshold value.

16. The diffusor according to claim 1, wherein the energizing fluid and the moving fluid have the same consistency.

17. The diffusor according to claim 1, wherein the energizing fluid and the moving fluid have different consistencies.

18. A turbine, comprising:

a rotor;

a casing for receiving a flow of fluid to drive said rotor, said rotor being disposed in said casing and being driven by the fluid; and a diffusor for decelerating the fluid, said diffusor being disposed in said casing downstream of said rotor in a flow direction of the fluid, said diffusor including:

at least one wall forming a channel for receiving the fluid, said at least one wall having an inlet, an outlet, and at least one opening for receiving an energizing fluid to be transported selectively into said channel, said inlet having a relatively smaller inlet flow cross section and said outlet having a relatively larger outlet flow cross section;

said channel defining an axial direction, the fluid entering the diffusor in said axial direction; and said channel defining a radial direction, the fluid discharging from the diffusor in said radial direction.

19. A low-pressure steam turbine, comprising:

a rotor;

a casing for receiving a flow of fluid to drive said rotor, said rotor being disposed in said casing and being driven by the fluid; and a diffusor for decelerating the fluid, said diffusor being disposed in said casing downstream of said rotor in a flow direction of the fluid and having at least one wall forming a channel for receiving the fluid, said at least one wall having an inlet, an outlet, and at least one opening for receiving an energizing fluid to be transported selectively into said channel, said inlet having a relatively smaller inlet flow cross section and said outlet having a relatively larger outlet flow cross section.

20. A gas turbine, comprising:

a rotor;

a casing for receiving a flow of fluid to drive said rotor, said rotor being disposed in said casing and being driven by the fluid; and a diffusor for decelerating the fluid, said diffusor being disposed in said casing downstream of said rotor in a flow direction of the fluid and having at least one wall forming a channel for receiving the fluid, said at least one wall having an inlet, an outlet, and at least one opening for receiving an energizing fluid to be transported selectively into said channel, said inlet having a relatively smaller inlet flow cross section and said outlet having a relatively larger outlet flow cross section.

21. A water turbine, comprising:

a rotor;

a casing for receiving a flow of fluid to drive said rotor, said rotor being disposed in said casing and being driven by the fluid; and a diffusor for decelerating the fluid, said diffusor being disposed in said casing downstream of said rotor in a flow direction of the fluid and having at least one wall forming a channel for receiving the fluid, said at least one wall having an inlet, an outlet, and at least one opening for receiving an energizing fluid to be transported selectively into said channel, said inlet having a relatively smaller inlet flow cross section and said outlet having a relatively larger outlet flow cross section.

22. A Francis turbine, comprising:

a rotor;

a casing for receiving a flow of fluid to drive said rotor, said rotor being disposed in said casing and being driven by the fluid; and a diffusor for decelerating the fluid, said diffusor being disposed in said casing downstream of said rotor in a flow direction of the fluid and having at least one wall forming a channel for receiving the fluid, said at least one wall having an inlet, an outlet, and at least one opening for receiving an energizing fluid to be transported selectively into said channel, said inlet having a relatively smaller inlet flow cross section and said outlet having a relatively larger outlet flow cross section.

23. A method for preventing shock boundary layer pulsations in a diffusor, which comprises:

measuring pressures of a moving fluid in a diffusor in a non-stationary manner;

evaluating amplitudes and frequencies of the measured pressures; and feeding energizing fluid into the diffusor if the amplitudes within a predetermined frequency band exceed a threshold value.

24. A method for preventing shock boundary layer pulsations in a diffusor, which comprises:

measuring pressures of a moving fluid at various locations in a diffusor;

evaluating amplitudes and frequencies of the measured pressures; and feeding energizing fluid into the diffusor if the amplitudes within a predetermined frequency band exceed a threshold value.

* * * * *